US010272316B2

(12) United States Patent
Hedberg

(10) Patent No.: US 10,272,316 B2
(45) Date of Patent: Apr. 30, 2019

(54) WEIGHTLIFTING EQUIPMENT AND METHODS

(71) Applicant: Jeffrey Hedberg, Bothell, WA (US)

(72) Inventor: Jeffrey Hedberg, Bothell, WA (US)

(73) Assignee: Jeffrey Hedberg, Bettendorf, IA (US)

( * ) Notice: Subject to any disclaimer, the term of this patent is extended or adjusted under 35 U.S.C. 154(b) by 146 days.

(21) Appl. No.: 15/336,468

(22) Filed: Oct. 27, 2016

(65) Prior Publication Data

US 2017/0120131 A1 May 4, 2017

Related U.S. Application Data

(60) Provisional application No. 62/249,707, filed on Nov. 2, 2015.

(51) Int. Cl.

| | |
|---|---|
| ***A63B 71/00*** | (2006.01) |
| ***A63B 71/02*** | (2006.01) |
| ***A63B 21/072*** | (2006.01) |
| ***A63B 21/078*** | (2006.01) |

(52) U.S. Cl.

CPC ..... *A63B 71/0036* (2013.01); *A63B 21/078* (2013.01); *A63B 21/0724* (2013.01); *A63B 2071/025* (2013.01); *A63B 2210/58* (2013.01)

(58) Field of Classification Search

CPC ..... A63B 21/0004; A63B 21/00047; A63B 21/078; A63B 21/0783; A63B 21/15; A63B 21/159; A63B 21/4027; A63B 21/4029; A63B 21/4033; A63B 21/4034; A63B 21/4045; A63B 21/4047; A63B 21/4049; A63B 22/0046; A63B 22/20; A63B 22/201; A63B 22/203; A63B 23/047; A63B 71/0036; A63B 71/0054; A63B 71/02; A63B 71/023; A63B 71/04; A63B 2071/0072; A63B 2071/0081; A63B 2071/009; A63B 2071/025; A63B 2071/026; A63B 2210/00; A63B 2210/06; A63B 2210/50; A63B 2210/58; A63B 2225/09; A63B 2225/093

See application file for complete search history.

(56) References Cited

U.S. PATENT DOCUMENTS

| | | | | |
|---|---|---|---|---|
| 1,063,620 A | | 6/1913 | Thornley | |
| 1,999,106 A | * | 4/1935 | Muller | B60B 33/06 16/34 |
| 2,042,489 A | * | 6/1936 | Williams | B60B 33/06 16/33 |

(Continued)

FOREIGN PATENT DOCUMENTS

| | | | | |
|---|---|---|---|---|
| GB | 624303 A | * | 6/1949 | B60B 33/06 |

*Primary Examiner* — Gary D Urbiel Goldner

(57) ABSTRACT

A weightlifting block and associated methods of use are provided. The weightlifting block includes rotatable platforms mounted to interior surfaces of sidewalls of the weightlifting block. Wheels are attached to the bottom surface of the platforms. An activation lever is rotatably connected to the platforms and is configured to lift the platforms from an active position to an inactive position, wherein the wheels extend past a bottom edge of the sidewalls to allow for the weightlifting block to be rolled to a desired location. The activation lever may then be disengaged to retract the wheels on the platform back into the weightlifting block.

16 Claims, 6 Drawing Sheets

(56) References Cited

U.S. PATENT DOCUMENTS 2,783,055 A * 2/1957 Michaud ..... B62B 3/0625 16/34
2,937,850 A * 5/1960 Winkler ..... B62B 3/0625 254/8 R
3,845,933 A * 11/1974 Heizer, Jr. ..... A47B 91/002 254/8 R
4,417,738 A * 11/1983 Kendall ..... B60B 33/06 16/34
4,815,760 A * 3/1989 Dooley ..... B25H 1/04 280/43.24
4,874,182 A * 10/1989 Clark ..... B62B 7/12 280/30
4,902,026 A * 2/1990 Maldonado ..... B60N 2/2848 280/30
5,348,326 A 9/1994 Fullenkamp et al.
5,474,311 A * 12/1995 Tyciak ..... B60N 2/01591 280/30
5,554,088 A * 9/1996 Zlojutro ..... A63B 69/004 482/83
5,628,522 A * 5/1997 Hall ..... B60B 33/06 280/43.14
5,876,173 A * 3/1999 English, Jr. ..... A47B 91/002 254/8 R
6,311,992 B1 * 11/2001 Theising ..... B62B 5/0083 280/43.13
6,432,003 B1 * 8/2002 van Nimwegen ... A63B 63/083 473/479
6,507,975 B2 * 1/2003 Maupin ..... B60B 33/0005 16/19
6,827,321 B1 12/2004 Murren et al.
7,051,853 B2 * 5/2006 Brown ..... A45C 5/14 190/1
7,100,976 B1 * 9/2006 Desalve ..... A45C 13/385 297/129
7,201,385 B2 4/2007 Renz et al.
7,513,479 B2 4/2009 Li
7,537,222 B2 * 5/2009 Hadar ..... B62B 5/049 280/43.12
8,511,693 B2 * 8/2013 Gass ..... B25H 1/04 280/43.14
8,632,045 B2 * 1/2014 Ma ..... A45B 23/00 135/16
8,636,327 B2 * 1/2014 Penner ..... B25H 3/025 280/43.17
8,657,246 B2 2/2014 Ma
9,045,253 B2 6/2015 Hacko et al.
9,555,309 B1 * 1/2017 LaBar ..... A63B 21/0724
2003/0134701 A1 * 7/2003 Nye ..... A63B 63/083 473/479
2005/0275175 A1 * 12/2005 Murphy ..... A63B 55/00 280/47.26
2006/0151966 A1 * 7/2006 Murphy ..... A63B 55/00 280/47.26
2007/0232461 A1 * 10/2007 Jenkins ..... A63B 21/0552 482/93
2009/0236809 A1 * 9/2009 Carver ..... B60T 1/14 280/43.12
2010/0187782 A1 * 7/2010 Facey ..... B60T 1/14 280/30
2011/0232704 A1 * 9/2011 Li ..... A45B 25/14 135/16
2012/0024329 A1 * 2/2012 Ma ..... E04H 12/2238 135/16
2013/0069328 A1 * 3/2013 Hetrick ..... B60B 33/0005 280/79.11
2015/0084296 A1 * 3/2015 Murphy ..... A63B 55/00 280/40
2015/0087485 A1 3/2015 Kimura
2015/0157892 A1 6/2015 Johnson

* cited by examiner

WEIGHTLIFTING EQUIPMENT AND METHODS

BACKGROUND

Unless otherwise indicated herein, the materials described in this section are not prior art to the claims in this application and are not admitted to be prior art by inclusion in this section.

Weightlifting blocks, otherwise known as jerk or pull blocks, are used in exercise routines and generally serve to aid in weightlifting training. Typically, a weightlifting block or a stack of weightlifting blocks is provided on either side of an athlete attempting to lift barbell equipment. The athlete begins a pull exercise by lifting the equipment from the weightlifting blocks, and then proceeds with a desired weightlifting motion. Upon completion of the motion, the athlete returns the weightlifting equipment to rest on the weightlifting blocks, unloading the athlete. The weightlifting blocks allow for removal of additional stress that would be caused by having to place the weightlifting equipment all the way to the ground, and thus enable the athlete to focus on weightlifting form and movement specifics during training. The blocks also allow for higher repetitions during a session. Weightlifting blocks also aid in allowing an athlete to continue training after an injury, such as a sore or injured lower back or knee.

Additionally, weightlifting blocks are designed to have substantial weight so that the blocks do not bounce when in use; wood blocks often weight in excess of 50 lbs and metal blocks in excess of 200 lbs. Because of their substantial weight, weightlifting blocks often occupy a dedicated location in a gym, taking up valuable floor space whether or not the blocks are in use. Carts with wheels, such as dollys, are typically used to move the blocks; however, removal of the carts from underneath the blocks can be cumbersome and difficult.

SUMMARY

A weightlifting apparatus is provided. In one aspect, the apparatus comprises at least one platform having a top surface and a bottom surface and at least one wheel attached to the bottom surface. At least one platform is rotatably mounted to one of the plurality of sidewalls and an activation lever is configured to lift the at least one platform from an inactive position to an active position. In the active position, the at least one wheel extends beyond a bottom edge of the plurality of sidewalls. In the inactive position, the at least one wheel is retracted within the block and does not extend beyond the bottom edge.

In another aspect, an example weightlifting block assembly includes at least one platform movable from a first position to a second position, a lever operably connected to and horizontally pivotable about the at least one platform, and a plurality of wheels affixed to the at least one platform. The plurality of wheels are activated when the platform is in the second position.

In a further aspect, an example method involves providing a weightlifting block having at least one platform connected to an interior wall of the weightlifting block and rotatable with respect to a pivot, and a lever rotatably mounted to the at least one platform. The method further involves translating the lever in a first direction to cause the at least one platform to rotate upon the pivot, and translating the lever in a second direction to lock the lever in an activated position. In the activated position the platforms are positioned such that wheels attached to the at least one platform extend beyond a bottom edge of the weightlifting block.

These as well as other aspects, advantages, and alternatives, will become apparent to those of ordinary skill in the art by reading the following detailed description, with reference where appropriate to the accompanying drawings.

DETAILED DESCRIPTION

Example weightlifting apparatuses and methods are described herein. Any example embodiment or feature described herein is not necessarily to be construed as preferred or advantageous over other embodiments or features. The example embodiments described herein are not meant to be limiting. It will be readily understood that certain aspects of the disclosed apparatuses and methods can be arranged and combined in a wide variety of different configurations, all of which are contemplated herein.

Furthermore, the particular arrangements shown in the Figures should not be viewed as limiting. It should be understood that other embodiments may include more or less of each element shown in a given Figure. Further, some of the illustrated elements may be combined or omitted. Yet further, an example embodiment may include elements that are not illustrated in the Figures.

1. Overview

Figure 1:
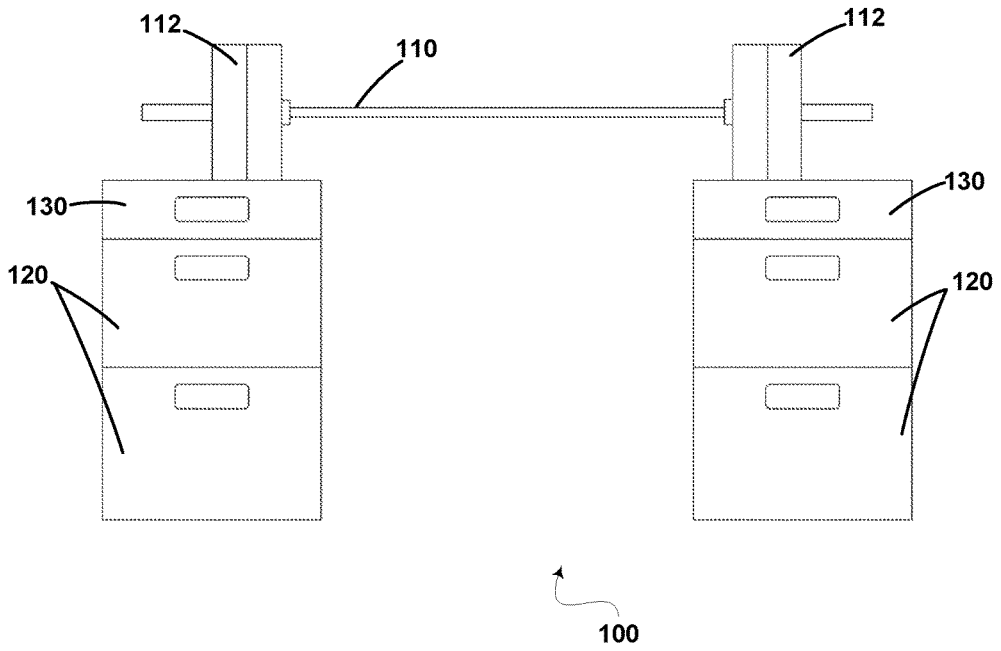
FIG. 1 depicts an example scenario 100 involving a barbell and weightlifting blocks.

Example embodiments disclosed herein generally relate to weightlifting blocks for use with weightlifting and associated exercise training. Weightlifting generally includes a steel bar, known as a barbell, holding one or more discs of different weights. The barbell is typically loaded incrementally with additional weights throughout an exercise and in a competition event. FIG. 1 depicts an example scenario 100 involving a barbell 110 and weightlifting blocks 120, 130. Weighted discs 112 positioned on barbell 110 are each shown resting on top of weightlifting blocks 120, 130.

There are different types of lifts that can be performed using the barbell; for example, a snatch lift involves the lifter having a wide grip on the barbell and pulling the barbell overhead without pressing out with the arms. Another example lift is referred to as the clean and jerk, wherein the lifter has a narrower grip on the barbell, and during the "clean" the lifter moves the barbell from the floor to a racked position across the lifter's deltoids and clavicles, and during the "jerk" the lifter raises the barbell to a stationary position above the lifter's head, finishing with straight arms and legs and feet in the same plane as the torso and the barbell, without a press out. Variants of these movements can also be performed, such as but not limited to the split jerk, the squat jerk, and the power clean.

Athletes often train to lift weights using weightlifting blocks to focus on portions or aspects of an entire lifting movement instead of performing the complexity of the entire movement. Advantageously, using weightlifting blocks allows a lifter to initiate a movement from the same position every time as opposed to initiating a movement from a hang position which results in variance for starting positions. Dissimilar starting positions can impact technique training. Further, after each lift, the barbell is returned to the block, unloading the lifter who drops the weight for the next lift without needing to continue all the way back to the ground; removing this stressor enables the lifter to focus entirely on his or her movement and the intended training.

Although weightlifting blocks have many advantages as previously discussed, the blocks are heavy and cumbersome, with metal blocks typically weighing as much as 200 lbs-400 lbs, and are thus difficult to move and store when not in use.

2. Example Weightlifting Block Assembly

Figure 2A:
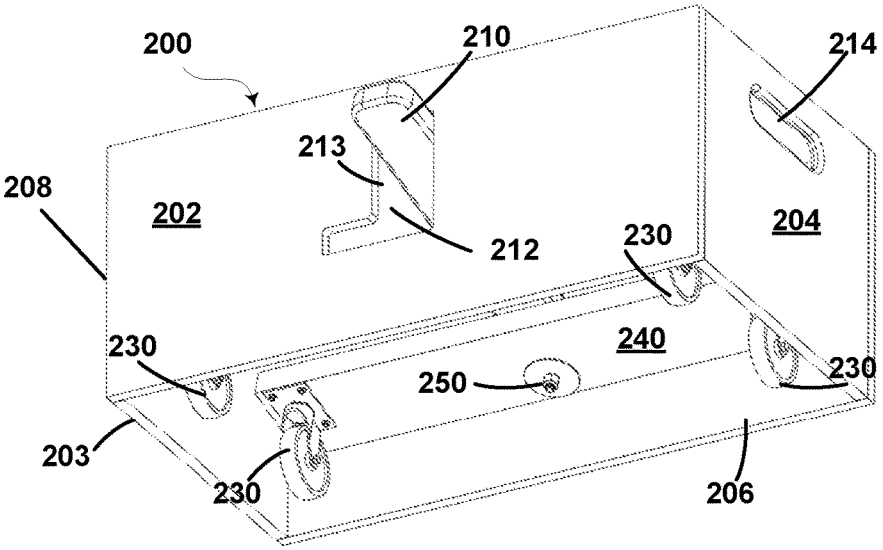
FIG. 2*a* depicts a weightlifting block in an inactive position, according to an example embodiment.

FIG. 2*a* depicts a weightlifting block assembly, block 200, in an inactive position, according to an example embodiment. As shown in FIG. 2*a*, block 200 includes four sidewalls 202, 204, 206, 208 defining an interior, a lever 210 extending through a cut-out 212 in sidewall 202, a throughhole 214 in sidewall 204 which serves as a hand grip, four wheels 230, wherein two wheels 230 are attached to each of two platforms 240, and an attachment mechanism 250 to connect one of the two platforms 240 to the lever 210. The weightlifting block 200 may be used in an exercise or training routine, and may be stacked and placed in a position such as shown in FIG. 1.

The block 200 may take various forms, which may be currently well-known or yet to be developed. For instance, the block 200 may be made of, at least in part, a high-strength material, such a metal like steel, or may be made of wood. In one example embodiment, the block 200 is modular and configured to be stackable. Additionally, the size of the block 200 may vary depending upon the particular implementation. The block 200 may have a top surface, and the four sidewalls 202, 204, 206, and 208, which define an interior. Block 200 may have an open bottom defined by a bottom edge along the perimeter of the four sidewalls.

Figure 2B:
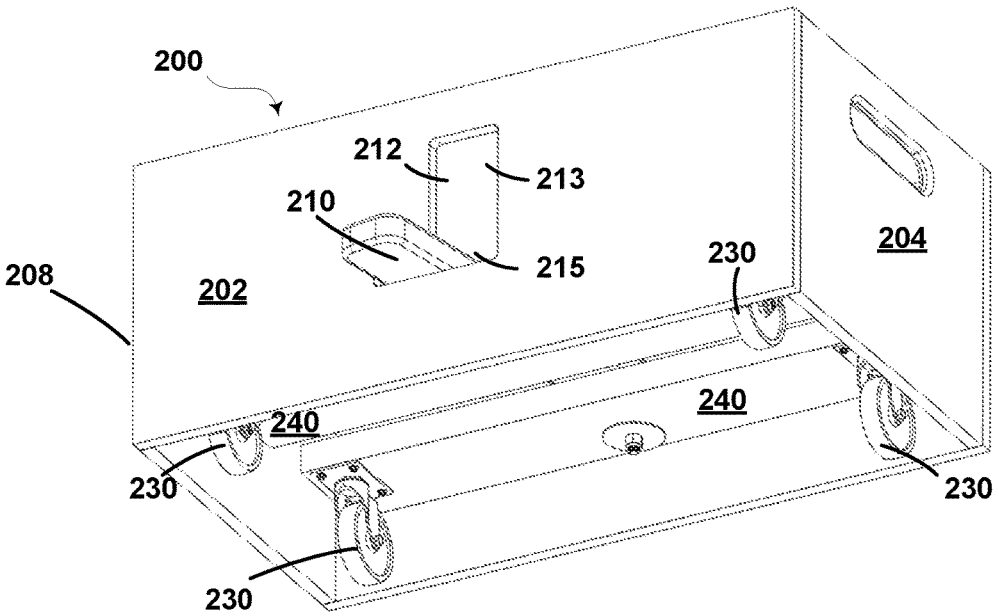
FIG. 2*b* depicts the weightlifting block of FIG. 2*a* in an activated position, according to an example embodiment.
Figure 3B:
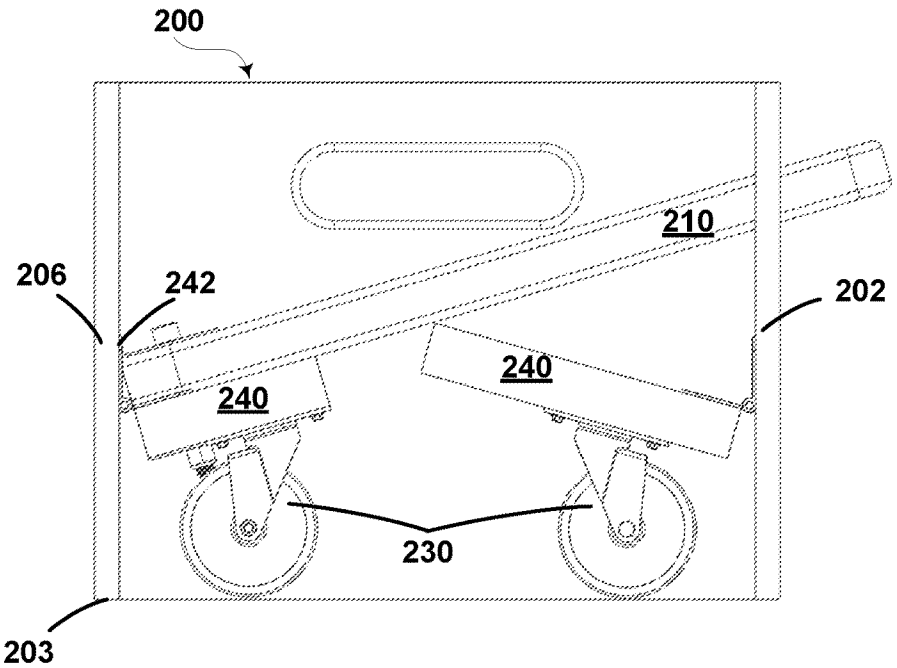
FIG. 3*b* depicts a front view of the cross-section depicted in FIG. 3*a* according to an example embodiment.
Figure 3A:
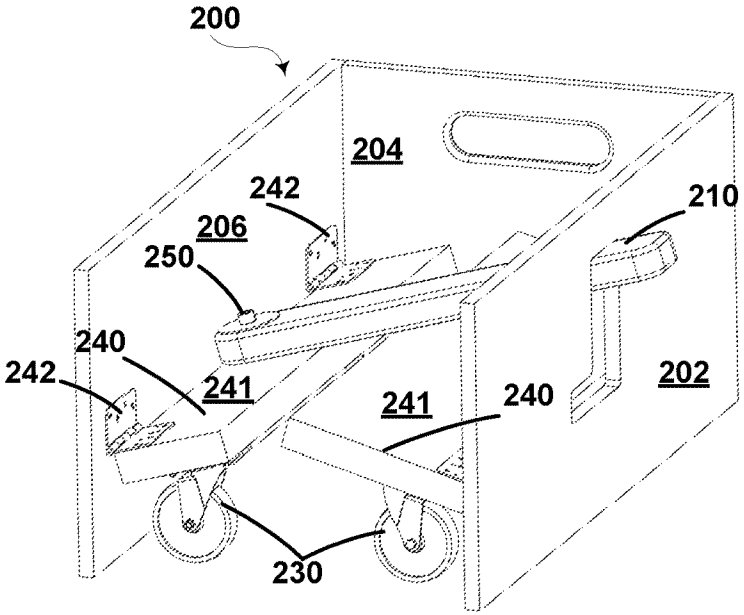
FIG. 3*a* depicts a cross-sectional view of the weightlifting block of FIG. 2*a* according to an example embodiment.

Two platforms 240 are depicted in FIGS. 2*a*-2*b*. Each of the platforms 240 is attached or connected to an interior surface of sidewalls 202, 206. In one example embodiment, each of the platforms 240 may be attached to the interior surface via one or more hinges, as depicted in FIG. 3*a*. Although hinges are shown to connect a platform to a sidewall, the platform may be connected to the sidewall using any of a number of mechanisms that allow for vertical rotation of the platform with respect to the sidewall. Although two platforms are shown in FIGS. 2*a*-5, in an alternative embodiment, a single platform may be present; the single platform may have more than two wheels attached thereto. The platforms 240 are depicted in FIGS. 2*a*-2*b* as rail-like structures, and the rails are shown with a space therebetween when in the inactive and the activated positions.

Four wheels 230 are shown in FIG. 2*a*; wheels 230 are attached to the underside or bottom surface of the platforms 240. In some example embodiments, wheels 230 are wheels that swivel, providing 360 degrees of rotation, such as caster wheels. Although four wheels 230 are shown in the embodiment depicted in FIGS. 2*a*-5, the application is not limited to four wheels, and less or more wheels may be attached to the bottom surface of the platforms 240. Moreover, in alternative embodiments, other components that provide for or facilitate movement may be envisioned in place of wheels, such as sliders, or spherical rollers.

Cut-out 212 extends through sidewall 202, and allows access to the interior of block 200. Cut-out 212 is shown as having a vertical portion 213 and a horizontal portion 215, forming, as shown in FIG. 2*a*, a reverse "L" shape.

Lever 210 is connected to a top surface of one of the platforms 240 and is anchored to the platform 240 via a bolted bushing 250. Preferably, lever 210 is connected to the platform that is attached to the sidewall opposite the sidewall comprising cut-out 212. Although a bolted bushing is depicted in the embodiments of FIGS. 2*a*-5, a number of different attachment mechanisms providing a pivot with respect to the platform may be used, including openings through which a pin is inserted, rotational bearing assemblies, captured pins/bearings/bolts, or other variants. Lever 210 may be a foot-activated or foot operated lever. Lever 210 is depicted in FIG. 2*a* within a vertical portion 213 of cut-out 212 and near or at the top of the vertical portion, thus in an inactive position. In the inactive position, platforms 240 are driven upwards by the caster wheels 230 through their contact with the ground due to the lever 210 being allowed to freely rotate upward in the vertical portion 213 of the cut-out 212. The platforms 240 are then angled less than 90 degrees with respect to the interior surface of the sidewalls 202, 206, resulting in the wheels 230 being drawn within the block 200 such that the wheels do not extend past bottom edge 203 of the block 200.

FIG. 2*b* depicts the weightlifting block 200 of FIG. 2*a* in an activated position, according to an example embodiment. In the activated position, lever 210 is transitioned from the vertical portion 213 of cut-out 212 to the horizontal portion 215. To transition the lever 210 from an inactive position as shown in FIG. 2*a* to the active position in FIG. 2*b*, a user may press his or her foot on top of the lever 210 and apply downward pressure to move the lever vertically downward, and then once the lever 210 reaches the bottom edge of the cut-out 212, continue to press the lever along the horizontal portion 215 of the cut-out 212 to effectively lock the lever 210 in place. Once the lever is locked in place, the user may remove pressure applied from their foot. In the activated position, platforms 240 are positioned parallel with the bottom edges of the sidewalls of the block 200. The location of platforms 240 within block 200 is such that when platforms 240 are positioned parallel with the bottom edges of block 200, at least a portion of the wheels 230 extends beyond bottom edge 203. Wheels 230 are thus in position to allow for rolling movement of the block to a desired location. Once block 200 is rolled to the desired location, the same lever 210 may be used to dis-engage wheels 230 by applying pressure to lever 210 to push the lever from the horizontal portion 215 of cut-out 212 back up through the vertical portion 213 of the cut-out 212, raising platforms 240 and thus retracting wheels 230 back within block 200. The weight of the block assembly aids in the retraction process by driving the caster wheels 230 upwards through their contact with the ground due to the lever 210 being allowed to freely rotate upward in the vertical portion 213 of the cut-out 212. The bottom edge 203 of the block sidewalls then once again rests on or abuts the ground, and block 200 will no longer be able to roll freely.

FIG. 3*a* depicts a cross-sectional perspective view of the weightlifting block 200 of FIG. 2*a* according to an example embodiment. In FIG. 3*a*, top surfaces 241 of platforms 240 can be seen, as well as hinges 242, which rotatably connect platforms 240 to the interior surface of sidewalls 206, 202. FIG. 3*b* depicts a front view of the cross-section depicted in FIG. 3*a* according to an example embodiment. As shown in FIG. 3*b*, the assembly is in the inactive position wherein platforms 240 are rotated upwards and wheels 230 are retracted and do not extend beyond the bottom edge 203 of the sidewalls.

Figure 4B:
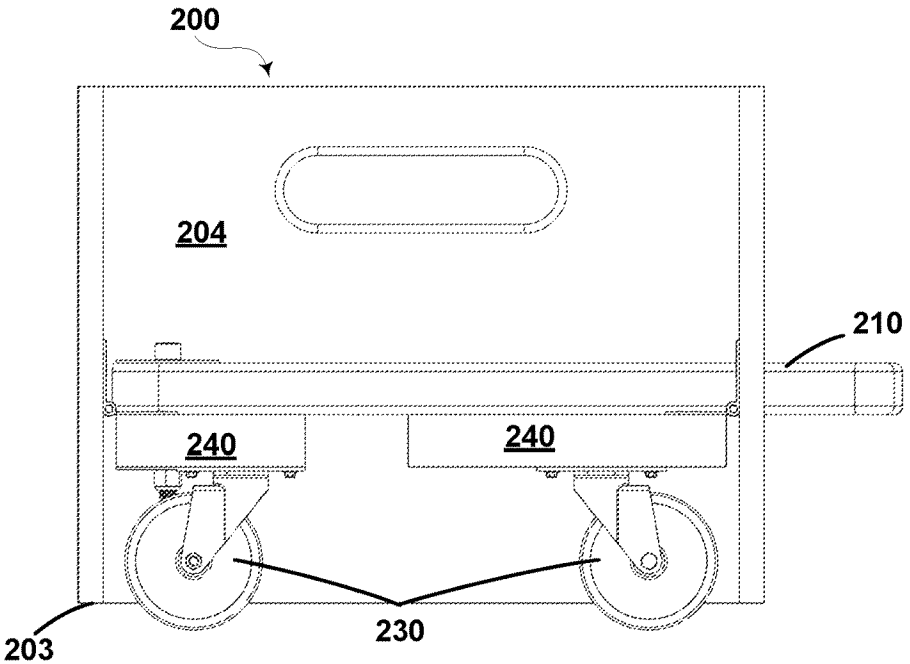
FIG. 4*b* depicts a front view of the cross-section depicted in FIG. 4*a* according to an example embodiment.
Figure 4A:
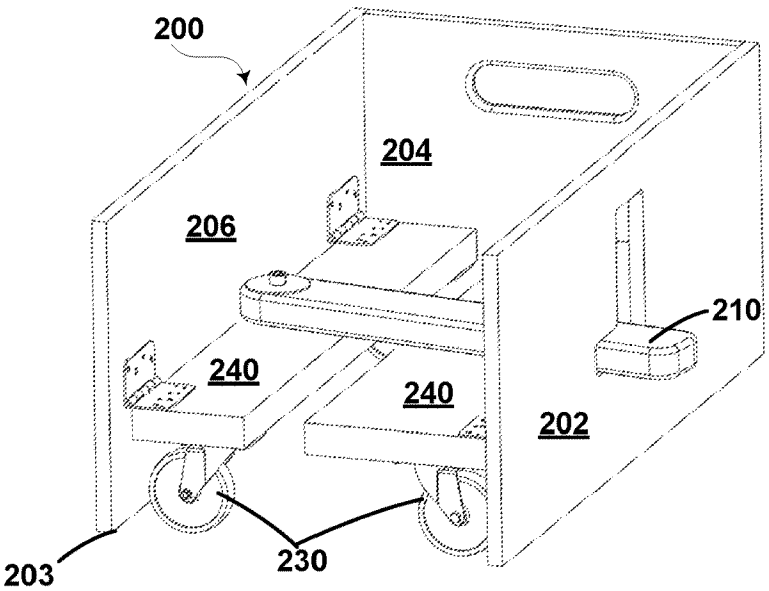
FIG. 4*a* depicts a cross-sectional view of the weightlifting block of FIG. 2*b* according to an example embodiment.

FIG. 4*a* depicts a cross-sectional view of block 200 of FIG. 2*b* according to an example embodiment. In FIG. 4*a*, lever 210 rests within the horizontal portion 215 of the cut-out 212, and lever 210 in turn presses platforms 240 in a downward direction toward bottom edge 203 of block 200, until both platforms 240 (and associated hinges) are positioned at an approximately 90 degree angle with respect to sidewalls 206, 202.

FIG. 4*b* depicts a front view of the cross-section of block 200 of FIG. 4*a*. As can be seen in FIG. 4*b*, in the activated position wheels 230 extend lower than or beyond bottom edge 203 of the sidewalls, allowing block 200 to be easily moved to a desired location. A bottom surface of the lever 210 is shown to abut a top surface of the platforms 240 in this configuration.

Figure 5:
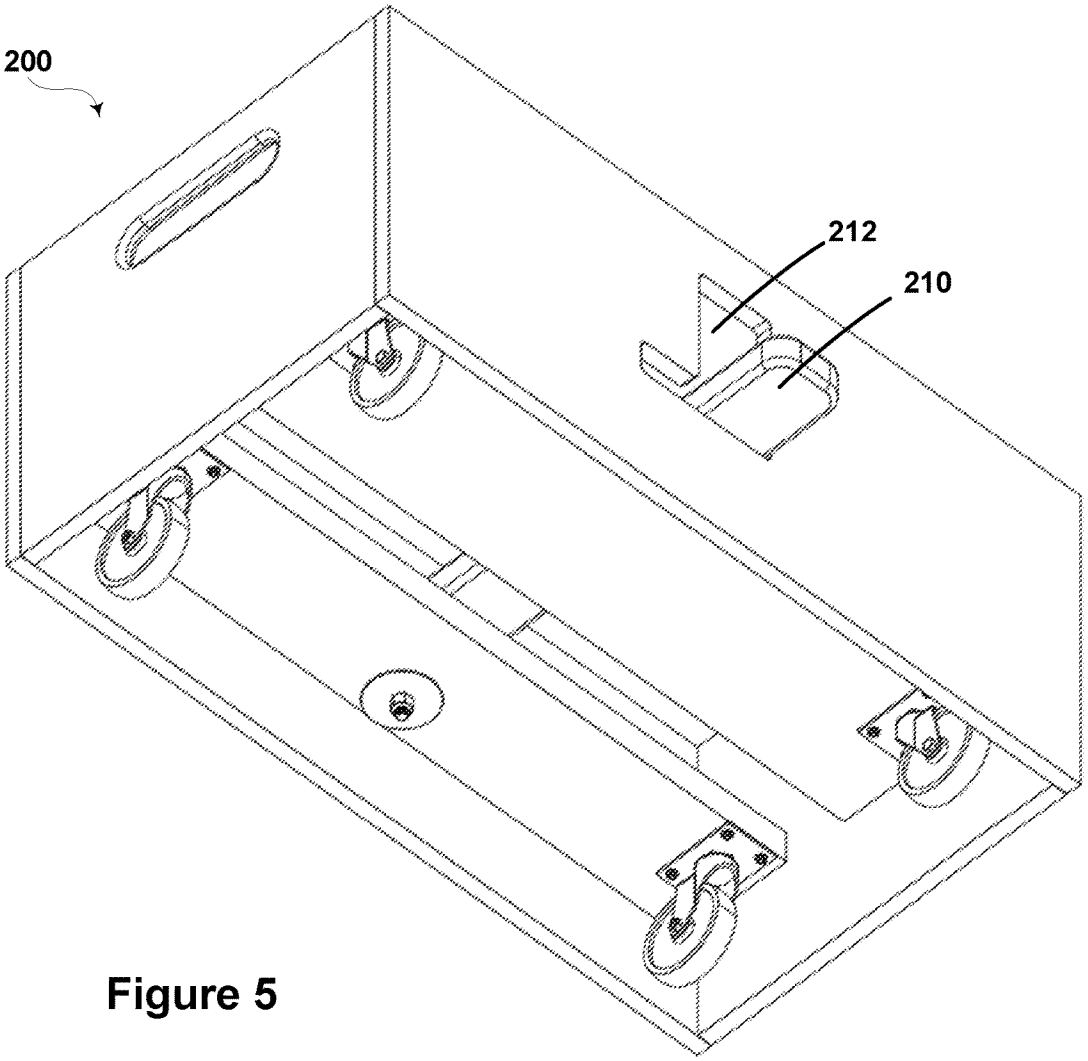
FIG. 5 depicts a bottom view of the weightlifting block of FIG. 2*a*, according to an example embodiment.

FIG. 5 depicts a bottom view of the weightlifting block of FIG. 2*a*, with the lever 210 in transition within cut-out 212, between the activated position and the inactive position.

It should be understood that variations on the illustrated weightlifting block assembly are possible. For example, the weightlifting block may take on various sizes and/or shapes, and be constructed from various materials, depending upon the implementation. It may also be activated through a number of mechanisms or powered systems other than the currently described method with a user's foot.

3. Illustrative Methods

Figure 6:
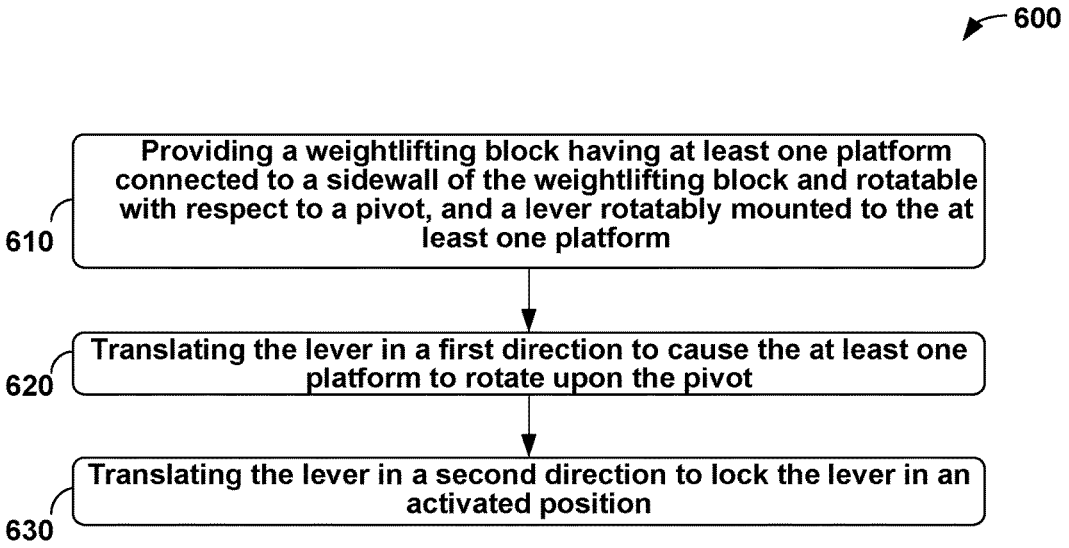
FIG. 6 is a flow chart of a method, according to an example embodiment.

FIG. 6 is a flow chart of a method 600 according to an example embodiment. The method 600 is a method to activate and de-activate wheels of a weightlifting block, such as the weightlifting block 200 of FIGS. 2*a*-5.

As shown by block 610, method 600 involves providing a weightlifting block having at least one platform connected to a sidewall of the weightlifting block and rotatable with respect to a pivot, and a lever rotatably mounted to the at least one platform. The lever is rotatable with respect to a pivot on the platform. The weightlifting block may be the weightlifting block 200 as described with respect to FIGS. 2*a*-5, for example. In one example embodiment, two platforms are provided, each being pivotable in a vertical direction with respect to a sidewall of the block. The lever may be connected to one of the two platforms and may be rotatable in a horizontal direction with respect to a pivot on the platform. The pivot used to fasten the lever to the at least one platform may be a bolted bushing, in one example embodiment. Because the lever is mounted to the platform and is not designed to pivot in the vertical direction with respect to the platform, vertical movement of the lever causes vertical movement of the platform and vice versa.

Then at block 620, method 600 involves translating the lever in a first direction to cause the at least one platform to rotate upon the pivot. The first direction may be a vertical direction and the lever may translate within the space provided by a through-hole in a sidewall, such as the cut-out 212 as described with respect to FIGS. 2*a*-5. Movement of the lever may be activated by a user's foot, in one example embodiment. The user may push down on a top surface of the lever to translate the lever downward vertically within the cut-out.

At block 630, method 600 involves translating the lever in a second direction to lock the lever in an activated position, wherein in the activated position, the platforms are positioned such that the wheels extend beyond a bottom edge of the weightlifting block. The second direction may comprise the lever pivoting about the bushing in a horizontal direction. When the lever pivots in a horizontal direction, the lever moves within a horizontal section of the cut-out, and may remain within the horizontal section of the cut-out to lock the platforms into place in the activated position. Other example embodiments may incorporate alternate locking mechanisms that do not require this additional step of translation a lever in an additional direction, and employing a single direction movement with a lockout mechanism and similar release.

4. Conclusion

The above detailed description describes various features and functions of the disclosed systems, devices, and methods with reference to the accompanying figures. While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A weightlifting apparatus comprising:

a block comprising a plurality of sidewalls;

at least one platform having a top surface and a bottom surface, at least one wheel attached to the bottom surface, and the at least one platform being rotatably mounted to one of the plurality of sidewalls; and an activation lever configured to lift the at least one platform from an active position to an inactive position;

wherein in the active position, the at least one wheel extends beyond a bottom edge of the plurality of sidewalls; and wherein in the inactive position, the at least one wheel is retracted within the block and does not extend beyond the bottom edge; and wherein a sidewall of the plurality of sidewalls further comprises a cut-out extending through the sidewall and having a vertical portion and a horizontal portion.

2. The weightlifting apparatus of claim 1, wherein the at least one platform comprises a first platform rotatably mounted via a hinge to the one of the plurality of sidewalls, and a second platform rotatably mounted via another hinge to another of the plurality of sidewalls.

3. The weightlifting apparatus of claim 1, wherein the activation lever is connected to the at least one platform and extends through the cut-out.

4. The weightlifting apparatus of claim 3, wherein the activation lever is rotatable along a horizontal axis with respect to the at least one platform.

5. The weightlifting apparatus of claim 4, wherein in the inactive position, the at least one platform is angled with respect to an interior surface of the one of the plurality of sidewalls, causing the at least one wheel to be drawn within the block.

6. The weightlifting apparatus of claim 5, wherein the plurality of sidewalls define an interior space and wherein the at least one platform is attached to the interior surface of the one of plurality of sidewalls and resides within the interior space.

7. The weightlifting apparatus of claim 6, wherein the at least one platform is positioned parallel with the bottom edge of the plurality of sidewalls.

8. The weightlifting apparatus of claim 1, wherein the activation lever is user activated.

9. A weightlifting block assembly comprising:

at least one platform movable from a first position to a second position;

a lever operably connected to and horizontally pivotable about the at least one platform; and a plurality of wheels affixed to the at least one platform;

wherein the plurality of wheels are activated when the platform is in the second position; and wherein the at least one platform is movable from the first position to the second position in correlation with vertical translation of the lever; and wherein a bottom surface of the lever abuts a top surface of the at least one platform in the second position; and wherein the lever extends through a cut-out in a sidewall of the weightlifting block assembly, the cut-out having a vertical portion and a horizontal portion.

10. The weightlifting block assembly of claim 9, wherein in the second position at least a portion of the plurality of wheels extends beyond bottom edges of the weightlifting block assembly.

11. The weightlifting block assembly of claim 9, wherein the at least one platform is mounted to a sidewall of the weightlifting block assembly and is rotatable with respect to a pivot.

12. The weightlifting block assembly of claim 11, wherein the pivot is a hinge.

13. A method comprising:

providing a weightlifting block having at least one platform connected to an interior wall of the weightlifting block and rotatable with respect to a pivot, and a lever rotatably mounted to the at least one platform;

translating the lever in a first direction to cause the at least one platform to rotate upon the pivot; and translating the lever in a second direction to lock the lever in an activated position, wherein in the activated position, the at least one platform is positioned such that wheels attached to the at least one platform extend beyond a bottom edge of the weightlifting block.

14. The method of claim 13, wherein translating the lever in the first direction causes the at least one platform to rotate upon the pivot in a vertical direction.

15. The method of claim 13, wherein the lever is rotatable in a horizontal direction with respect to the at least one platform.

16. The method of claim 13, wherein in the activated position, a bottom surface of the lever abuts a top surface of the at least one platform and forms a 90 degree angle with respect to a sidewall of the weightlifting block.

* * * * *